United States Patent [19]

Monser et al.

[11] Patent Number: 4,803,495

[45] Date of Patent: Feb. 7, 1989

[54] RADIO FREQUENCY ARRAY ANTENNA WITH ENERGY RESISTIVE MATERIAL

[75] Inventors: George J. Monser, Goleta; Albert A. Roy, Lompoc, both of Calif.

[73] Assignee: Raytheon Company, Lexington, Mass.

[21] Appl. No.: 936,918

[22] Filed: Nov. 26, 1986

Related U.S. Application Data

[63] Continuation of Ser. No. 690,074, Jan. 9, 1985.

[51] Int. Cl.[4] ..... H01Q 3/00; H01Q 13/02

[52] U.S. Cl. ..... 343/777; 343/786; 343/725

[58] Field of Search ..... 343/725, 776, 777, 786, 343/840, 778

[56] References Cited

U.S. PATENT DOCUMENTS

| | | | |
|---|---|---|---|
| 2,349,942 | 5/1944 | Dallenbach | 343/776 |
| 2,460,869 | 2/1949 | Braden | 343/840 |
| 2,878,470 | 5/1954 | Butler | 343/763 |
| 2,878,471 | 2/1955 | Butler | 343/763 |
| 3,140,491 | 1/1963 | Ashbaugh et al. | 343/912 |
| 3,274,602 | 9/1963 | Randall et al. | 343/762 |
| 3,732,571 | 5/1973 | Neale | 343/786 |
| 4,115,782 | 9/1978 | Han et al. | 343/840 |
| 4,353,072 | 10/1982 | Monser | 343/725 |
| 4,353,074 | 10/1982 | Monser et al. | 343/786 |
| 4,380,014 | 4/1983 | Howard | 343/786 |
| 4,672,384 | 6/1987 | Roy et al. | 343/786 |

FOREIGN PATENT DOCUMENTS

| | | | |
|---|---|---|---|
| 1091260 | 4/1955 | France | 343/786 |

*Primary Examiner*—William L. Sikes
*Assistant Examiner*—Doris J. Johnson
*Attorney, Agent, or Firm*—Richard M. Sharkansky; Edmund J. Walsh

[57] ABSTRACT

An array antenna is provided wherein each adjacent pair of a plurality of antenna elements in such array antenna have a common, conductive wall having a castellated radiating edge. Radio frequency energy resistive material is disposed within slots formed in the radiating edge. With such arrangement, electrical coupling between the adjacent pair of antenna elements is reduced thereby improving the gain of the antenna at the lower frequency operating band of the antenna. Further, the electric field distribution is redistributed by the slotted radiating edge from a cosine distribution associated with a linear edge to a more flattened, uniform distribution to increase the effective aperture of the element in the H-plane.

8 Claims, 4 Drawing Sheets

FIG. 3
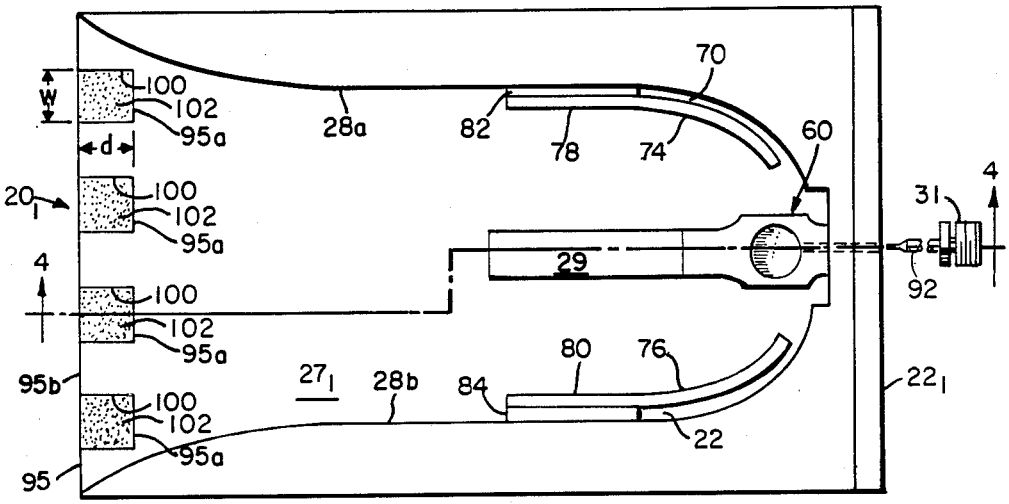
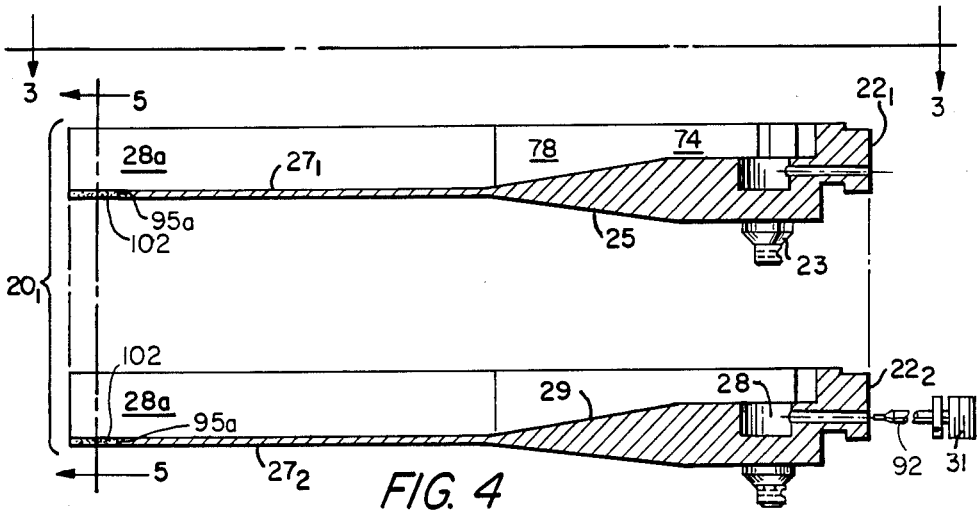
FIG. 4
FIG. 5
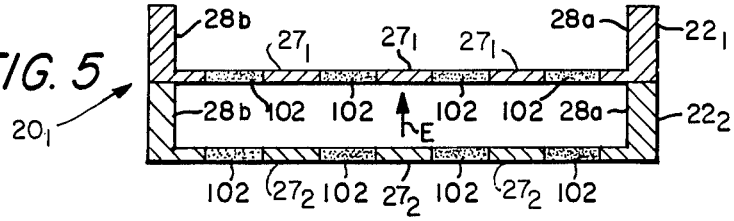

RADIO FREQUENCY ARRAY ANTENNA WITH ENERGY RESISTIVE MATERIAL

This application is a continuation of application Ser. No. 690,074, filed Jan. 9, 1985.

BACKGROUND OF THE INVENTION

This invention relates generally to radio frequency antennas, and more particularly to radio frequency array antennas.

As is known in the art, it is sometimes desirable to arrange a plurality of antenna elements in an array to provide an antenna with a relatively narrow beam width. As is further known in the art, in an array antenna the spacing "a" between the centers of adjacent antenna elements must be less than $[1-(1/N)]\lambda_H/(1+\sin\theta)]$ (where N is the number of antenna elements along a scan axis of the array antenna, $\lambda_H$ is the wavelength of the highest operating frequency of the array antenna and $\theta$ is the maximum angular duration of the beam from the boresight axis of the array antenna) in order to obtain satisfactory grating lobe reductions. Thus, in wide bandwidth, wide-scan angle arrays, the element to element spacing, "a", becomes very small in terms of wavelengths at the lower operating frequencies in order to avoid grating lobes at the higher operating frequencies. As is also known in the art, one type of antenna element used in an array antenna is a horn. When such horn antenna elements are disposed in an array, and more particularly stacked one aside another in a direction along the E-field of the propagating energy, there is a degree of electrical coupling among the elements, particularly when the antenna is operating at the lower frequency region of the operating bandwidth, with the result that the gain of the antenna is degraded at the lower operating frequencies of the antenna.

SUMMARY OF THE INVENTION

In accordance with the present invention, an array antenna is provided wherein each adjacent pair of a plurality of antenna elements in such array antenna has a conductive wall therebetween with a radiating edge having a series of discontinuities therein. In a preferred embodiment, the radiating edge has rearward radiating edge portions interposed with forward radiating edge portions. In accordance with an additional feature of the invention, radio frequency energy resistive material is disposed forward of the rearward radiating edge portions and between each adjacent pair of forward radiating edge portions of the common radiating edge.

With such arrangement, electrical coupling between each adjacent pair of antenna elements is reduced thereby improving the gain of the antenna at the lower frequency operating range of the antenna. Further, the electric field distribution is redistributed from a normal cosine distribution, as with a linear radiating edge, to a more flattened, uniform distribution to increase the effective aperture in the H-plane.

BRIEF DESCRIPTION OF THE DRAWINGS

The foregoing features of the invention, as well as the invention itself, may be more fully understood from the following description read together with the accompanying drawings in which:

FIG. 3 is a plan view of a pair of adjacent members of FIG. 2;

FIG. 4 is a cross-sectional exploded view of the pair of adjacent members of FIG. 3, such cross-sections being along line 4—4 of FIG. 3;

FIG. 5 is a cross-sectional end view of the pair of members of FIG. 4, such cross-section being taken along Line 5—5;

DESCRIPTION OF THE PREFERRED EMBODIMENT

Figure 1:
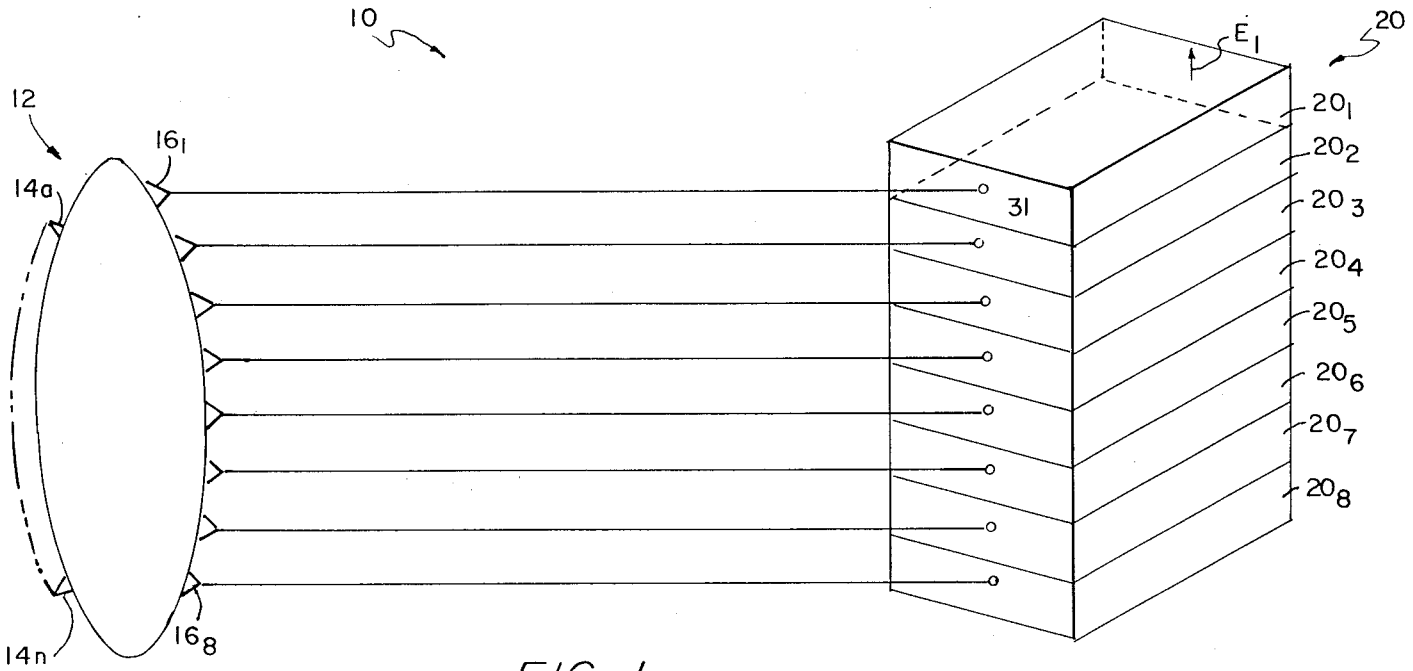
FIG. 1 is a schematic diagram of an array antenna system. according to the invention.

Referring now to FIG. 1, a multibeam radio frequency antenna system 10 is shown to include a radio frequency lens 12 having a plurality of feed ports **14*a*–14*n* disposed along a portion of the periphery of such lens 12 and a plurality of, here eight, array ports $\mathbf{16_1}$–$\mathbf{16_8}$ disposed along an opposing portion of the lens 12, the plurality of array ports $\mathbf{16_1}$–$\mathbf{16_8}$ being coupled to an array 20 (here a linear array) of a plurality of, here eight, identically constructed antenna elements $\mathbf{20_1}$–$\mathbf{20_8}$. The shape of the lens 12**, and the arrangement of the antenna elements $\mathbf{20_1}$–$\mathbf{20_8}$ are selected such that n collimated beams of radio frequency energy are formed in free space, each one of such n beams having a different direction and such one of such n beams here having vertical polarization.

Figure 2:
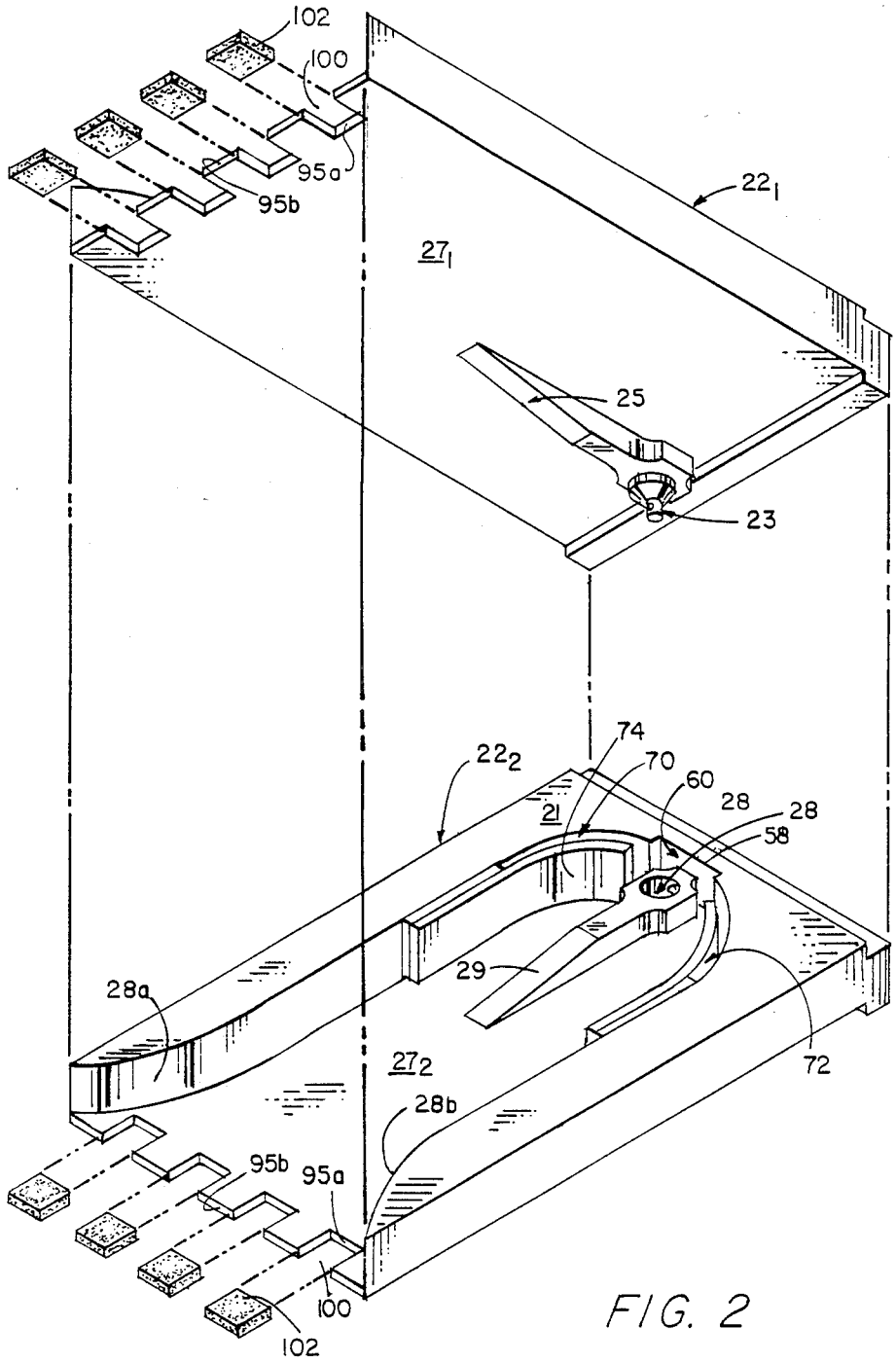
FIG. 2 is an isometric, exploded view of a pair of members which when affixed together form an exemplary one of the antenna elements in the array antenna of FIG. 1.

Referring now to FIG. 2, an exemplary one of the plurality of identically constructed antenna elements $\mathbf{20_1}$–$\mathbf{20_8}$, here antenna element $\mathbf{20_1}$, is shown in detail to include a pair of identically constructed conductive members $\mathbf{22_1}$, $\mathbf{22_2}$. When the bottom plate $\mathbf{27_1}$ of member $\mathbf{22_1}$ is disposed on the top surface of member $\mathbf{22_2}$, the port 23 of the upper tapered ridge 25 formed on the bottom plate $\mathbf{27_1}$ of member $\mathbf{22_1}$ is disposed within the aperture 28 formed on the lower tapered ridge 29 formed on the upper surface of bottom plate $\mathbf{27_2}$ of member $\mathbf{22_2}$ (FIGS. 2, 3, 4 and 5) a rectangular cross-section waveguide is formed having an open front and a rearward, double ridge feed fed via coaxial connector 31 as described in our U.S. Pat. No. 4,353,074 entitled "Radio Frequency Ridged Waveguide Antenna", issued Oct. 5, 1982 and assigned to the same assignee as the present invention. Such formed waveguide is thus adapted to transmit and/or receive radio frequency energy having a linear polarization with the electric field vector $\bar{E}$ (FIG. 5) thereof in the E-plane i.e., the vertical plane perpendicular to the H-plane of the plates $\mathbf{27_1}$, $\mathbf{27_2}$ of members $\mathbf{22_1}$, $\mathbf{22_2}$ which form the opposing ridge walls of the waveguide, as shown by the vector $E_1$ in FIG. 1.

Each one of the members $\mathbf{22_1}$, $\mathbf{22_2}$ is constructed from a block of electrically conductive material, here aluminum. The upper surface 21 of such block has machined therein S-shaped side walls **28*a*, 28*b* and a rear wall portion 58 has a recess or notch 60 formed therein. Also, machined into the upper surface 21 of the members $22_1$, $22_2$ is the tapered ridge 29, as shown. The tapered ridge 29 has aperture 28 formed in the upper, flat top portion thereof the flat portion terminating in a tapered portion, as shown. It is noted that the separation between the opposing narrow side walls 28***a*, 28*b* disposed laterally of the tapered portions of ridge 29 is relatively constant, however, such separation decreases, here along curved paths, as such rear wall portions extend towards he rear wall 58. Disposed along the curved regions of the side walls 28*a*, 28*b* are open-ended channels 70, 72. Channels 70, 72 are here formed of curved strips 74, 76, here aluminum, having ends 78, 80 spaced from and affixed to side walls 28*a*, 28*b*, respectively. The spacing is provided by aluminum spacers 82, 84, such ends 78, 80 and spacers 82, 84 being affixed to the side wall portions through a conventional means as bolts or a suitable epoxy, not shown. The channels 70, 72 are effective in removing unwanted surface currents produced along the side walls 28*a*, 28*b* as described in the above-referenced U.S. Pat. No. 4,353,074.

The side walls 28*a*, 28*b* disposed between the tapered ridge 29 and the front end of the member $22_2$ are flared outwardly along a non-linear path to increase the surface lengths of the side walls 28*a*, 28*b* from the tapered ridge 29 to free space within the fixed longitudinal length of the antenna element $22_1$ thereby providing a relatively compact antenna element with a side wall sufficiently large to provide an adequate transition region between the tapered ridge and free space.

It is noted that the front edge 95 of the conductive member $22_2$ is formed with rearward radiating edge portions 95*a* (i.e., slots) interposed with forward radiating edge portions 95*b* (i.e., teeth). Thus, the front (or radiating) edge 95 of member $22_2$ has a plurality of rectangular slots 100, or castellations, formed therein to produce a series of the teeth 95*b* or castellations. Thus, referring also to FIG. 3, the widths, W, of each slot is here $0.1\lambda_{\angle}$(where $\lambda_{\angle}$ is the wavelength of the lowest operating frequency of the antenna system 10). Further, each of the slots 100 has a depth, D, also of $0.05\lambda_{\angle}$. The spacing between adjacent slots 100 is also $0.08\lambda_{\angle}$. The length of the radiating, or front edge 95 is here $0.9\lambda_{\angle}$. Here, four slots 100 are interposed between five forward portions 95*b* of the radiating edge 95; thus, about half the radiating edge 95 has rearward portions 95*a* and half forward portions 95*a*. Disposed within each of the slots 100 is a slab 102 of radio frequency energy resistive material having a resistivity in the order of 25 to 1,000 ohms per square, here 50 ohm per square Mylar material manufactured by Norsal Industries, Brentwood, N.J. 11717.

Figure 6:
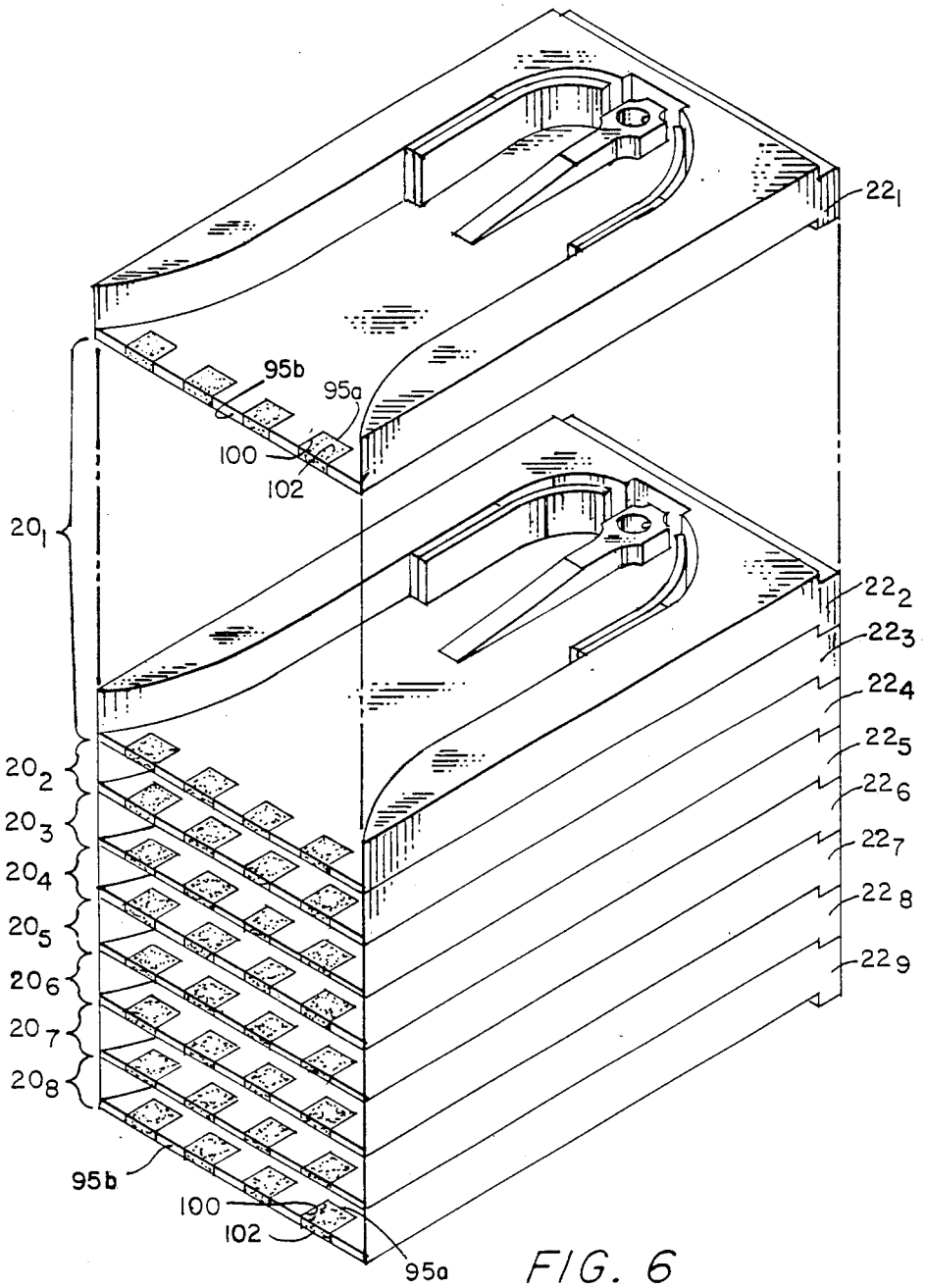
FIG. 6 is an isometric, partially exploded view of the array of antenna elements.

Referring again to FIG. 2, the bottom surface of plate $27_1$ of member $22_1$ (which is as noted above identical to member $22_2$) has the tapered ridge 25 formed therein. The flat portions of the ridge 25 has the turret shaped port 23 press fit therein by a pin-shaped end as described in U.S. Pat. No. 4,353,074 referred to above. Post 23 has a hole drilled therein for receiving the center conductor 92 (FIGS. 3 and 4) of the coaxial connector 31 as described in U.S. Pat. No. 4,353,074. It is noted from FIGS. 2, 3, 4 and 5 that the tapered ridges 25, 29 formed in the upper and lower surfaces of member $27_1$ are in alignment or registration with each other. Further, it is evident that the port 23 of member $22_1$ fits into aperture 28 of member $27_2$, as shown and as described in detail in U.S. Pat. No. 4,353,074. As noted from FIG. 6, the array 20 of antenna elements $20_1$–$20_8$ is shown; it being noted that in order to form the array 20 of eight antenna elements $20_1$–$20_8$, nine identical members $22_1$–$22_9$ are used. It is also noted that notches 100 are the front or radiating edges 95 of the conducting wide walls forming each antenna element $20_1$–$20_8$ (i.e., the upper and lower conductive wide walls of the formed waveguide) alter the radiating field from one produced if the radiating edges 95 were merely along a straight line. The altered field reduces coupling between adjacent antenna elements $20_1$–$20_8$ when configured in array 20 (FIGS. 1 and 6). Further, the use of resistive material for slabs 102 further improves the degree of decoupling between adjacent ones of the antenna elements $20_1$–$20_8$ to thereby improve the gain of the antenna system 10 of the lower frequency range of the operating band of the antenna. That is, by forming the front, or radiating, edges 95 of the upper and lower wide walls of the waveguide with castellations, each antenna element $20_1$–$20_8$ has a series of discontinuites produced in the electric field vector terminating walls.

Figure 7B:
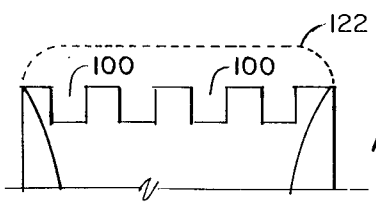
FIGS. 7A and 7B are diagrams used to compare the electric field distributions produced by an antenna element having a linear conductive radiating edge and the antenna element of FIG. 2 having a slotted conductive radiating edge according to the invention, the former being illustrated in FIG. 7A and the latter in FIG. 7B.
Figure 7A:
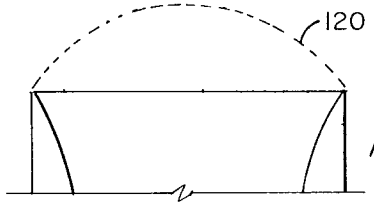

Referring now to FIGS. 7A and 7B, FIG. 7A shows the conventional cosine shaped electric field distribution 120 associated with a rectangular waveguide antenna element having its H-plane wide wall conductors with linear radiating edges. The effect of forming the wide walls of antenna element $20_1$ with slots 100 in the radiating edge is to redistribute the electric field distribution in the H-plane to a more uniform distribution 122. Thus, the effective aperture of the antenna element is increased in the H-plane. Here the radiating edge is broken by fifty per cent. Thus, referring to FIG. 6 and considering an adjacent pair of the linear antenna elements $20_1$–$20_8$, here the pair of antenna elements $20_1$, $20_2$. It is first noted that the antenna elements $20_1$–$20_8$ are disposed along the E-plane, i.e., along the same direction as the electric field produced between the wide walls of the formed waveguide. Further, the height of the side walls 28*a*, 28*b*, thus the separation between the centers of an adjacent pair of the antenna elements $20_1$–$20_8$, is here $0.146\lambda_{\angle}$. Next, considering a point disposed at the center of the radiating aperture of antenna element $20_1$ and a point disposed at the center of the radiating aperture $20_2$, it is noted that the path which passes between the points through the center conductive front edge portion 95*b* of the common conductive wall $27_2$ between elements $22_1$, $22_2$ has a length $0.146\lambda_{\angle}$; however, the path which passes between the points through the adjacent slot 100 has a longer length. Here, the path length difference is selected so that the energy passing between points via the shorter path is some what "out of phase" from the energy passing between the points via the longer path. The difference in phase is chosen to obtain a partial cancellation of the unwanted energy coupling between the adjacent antenna elements $20_1$, $20_2$. Since the slots 100 occupy about fifty per cent of the radiating edge 95, about one-half of the coupled energy arrives partially "out-of-phase" to obtain partial cancellation. Next, the resistive material slabs 102 provide further improvement in the degree of decoupling between adjacent ones of the antenna elements $20_1$–$20_8$.

Having described a preferred embodiment of the invention, it is now evident that other embodiments incorporating these concepts may be used. For example, while here square shaped slots have been shown, other shapes may be used. Further, while a double ridge fed waveguide has been shown, other feeds may be used. It is felt, therefore, that the invention should not be restricted to the disclosed embodiment, but rather should be limited only by the spirit and scope of the appended claims.

What is claimed is:

1. An array antenna comprising a plurality of antenna elements, adjacent ones of the plurality of antenna elements having a conductive wall disposed therebetween, said conductive wall being disclosed in the H-plane of the antenna and having a conductive radiating edge having a plurality of discontinuities formed therein, including radio frequency energy resistive material disposed within the regions of the discontinuities.

2. An array antenna comprising a plurality of antenna elements, adjacent ones of such elements having a conductive wall therebetween, said conductive wall being disposed in the H-plane of the antenna and comprising castellations disposed in a conductive radiating edge of said conductive wall, including radio frequency energy resistive material disposed within portions of the castellations.

3. An array antenna comprising a plurality of antenna elements, each one of such elements comprising means for producing radio frequency energy having an electric field in an E-plane of said antenna element, adjacent ones of the plurality of antenna elements having a conductive wall therebetween and disposed in an H-plane of said adjacent ones of the plurality of antenna elements, such conductive wall comprising a plurality of forward radiating edge portions interspersed with rearward radiating edge portions, such forward and rearward portions being disposed in the H-plane of said adjacent ones of the plurality of antenna elements and including radio frequency resistive material disposed between sucessive forward radiating edge portions.

4. An antenna element comprising means for producing radio frequency energy having an electric field substantially solely in an E-plane of the element and having a pair of conductive walls disposed in an H-plane of the antenna element, such conductive walls having radiating edges with a series of discontinuites formed therein, with radio frequency energy resistive means being disposed within the regions of the discontinuities.

5. The antenna element recited in claim 6 wherein the series of discontinuities comprise a plurality of forward radiating edge portions interposed with rearward radiating edge portions, such forward and rearward portions being disposed in the H-plane of the antenna element.

6. An antenna element comprising means for producing radio frequency energy having an electric field in an E-plane of the element and having a pair of conductive walls disposed in an H-plane of the antenna element, such conductive walls having a plurality of forward radiating edge portions interposed with rearward radiating edge portions, such forward and rearward portions being disposed in the H-plane of the antenna element; and, including radio frequency energy resistive material disposed forward of the rearward radiating edge portions between adjacent radiating forward radiating edge portions.

7. An array antenna comprising: a plurality of adjacently-disposed antenna elements, adjacent ones of such elements having a conductive wall disposed therebetween, such wall having discontinuities in such wall in a conductive radiating edge; and including radio frequency energy resistive material disposed within portions of the discontinuities.

8. An antenna element comprising:

(a) means for producing radio frequency energy having an electric field in an E-plane of the antenna element, the electric field having a distribution in an h-plane of the antenna element, said electric field distribution in the H-plane being nominally substantially nonuniform; and (b) a conductive wall disposed in teh H-plane of the antenna element, said conductive wall comprising means for redistributing the nominally substantially nonuniform electric field distribution in the H-plane, said redistributing means comprising a plurality of castellations disposed in a conductive radiating edge of said conductive wall further comprising radio frequency energy resistive material disposed within portions of said castellations.

* * * * *